United States Patent [19]

Paterson

[11] 3,957,629

[45] May 18, 1976

[54] ADJUSTABLE AIR CLASSIFIER DRUM AND CONVEYOR

[75] Inventor: Malcolm M. Paterson, Atkinson, N.H.

[73] Assignee: Raytheon Company, Lexington, Mass.

[22] Filed: May 22, 1975

[21] Appl. No.: 580,104

[52] U.S. Cl. ..... 209/136; 209/152

[51] Int. Cl.[2] ..... B07B 4/06

[58] Field of Search ..... 209/134–137, 209/152, 473, 288, 294, 298, 297, 284, 147, 257, 482; 198/233, 36

[56] References Cited

UNITED STATES PATENTS

| | | | |
|---|---|---|---|
| 1,186,874 | 6/1916 | Baer | 209/137 X |
| 1,981,318 | 11/1934 | James | 209/152 X |
| 2,208,092 | 7/1940 | Addis | 209/482 X |
| 3,358,809 | 12/1967 | Sukurs et al. | 198/36 |
| 3,804,249 | 4/1974 | Gibbons et al. | 209/482 X |

*Primary Examiner*—Frank W. Lutter
*Assistant Examiner*—Ralph J. Hill
*Attorney, Agent, or Firm*—Harold A. Murphy; Joseph D. Pannone; John T. Meaney

[57] ABSTRACT

An air classifier drum for receiving mixed materials and separating them into light and heavy materials, the heavy materials being dropped from one end of the drum during operation onto a conveyor, the drum being rotatable about an axis disposed at a selected angle to the horizontal and being vertically adjustable to the selected angle, the conveyor being vertically adjustable with the drum so that it will be constantly retained at a reasonably close-spaced relation to the drum to assure minimum impact of the heavy materials on the conveyor as they are discharged from the drum.

7 Claims, 3 Drawing Figures

ADJUSTABLE AIR CLASSIFIER DRUM AND CONVEYOR

BACKGROUND OF THE INVENTION

In the processing and recovery of waste materials it has become well known that mixed waste materials may be conveniently separated into light and heavy materials by a rotary drum through which a stream of air is made to flow at high velocity. A suitable conveyor penetrates into one end of the drum and deposits the mixed materials in a suitable location within the drum. The drum is made to rotate about a longitudinal axis which is disposed at a selected angle to the horizontal. Thus, the mixed materials will be lifted and dropped within the drum as it is rotated.

During such agitation of the materials within the drum, it has been found that light materials will be entrained within the air stream and will be carried out the upper end of the drum for further processing, use or disposal. The heavy materials will be moved progressively downwardly in the drum and will eventually fall out the lower end of the drum.

It has been found that the ratio of lights-to-heavies may be regulated by controlling the angle of inclination of the drum and consequently varying the velocity of the air stream flowing through the drum. Therefore, there is provided means for raising and lowering one end of the drum so as to change its angle of inclination as desired. Usually this is done by raising or dropping the lower end since the upper end is desirably retained in a predetermined relationship with other processing apparatus. Therefore, the lower end of the drum, that end from which heavy materials are allowed to drop, is raised or lowered to adjust the drum to a selected angle of inclination, and thus the drum is moved about an axis at or adjacent its upper end from which light materials are extracted by the air stream.

A primary conveyor, preferably a trough-shaped belt conveyor, is usually disposed beneath the lower end of the drum in order to receive and carry away the heavy materials dropping from the drum. It will be apparent that if the drum is inclined to a relatively extreme angle of inclination from the horizontal, the distance from the primary conveyor to the drum may be relatively short. Therefore, the heavy materials will fall a short distance to the conveyor with relatively low impact thereon. However, as the end of the drum is raised toward the horizontal, the distance between it and the conveyor increases. Accordingly, when the drum is in one of its higher positions, the heavy materials are required to fall a considerable distance, sometimes a distance of several feet when large drums are used. It will be apparent that in such cases the heavy materials will impact very heavily upon the conveyor, possibly causing damage to it. In some cases also the materials might actually miss engagement with the conveyor altogether.

SUMMARY OF THE INVENTION

The above and other problems of the prior art are overcome in the apparatus of the present invention wherein a rotary drum air classifier is mounted on a suitable platform and means is provided for moving the platform to adjust the angle of inclination of the drum. In accordance with this invention, the platform carries a secondary or associate conveyor section which is located in a fixed position beneath the platform and is always retained in relatively close-spaced relation to the drum at its lower end so that heavy items will fall only a relatively short distance to the conveyor section. The conveyor section extends longitudinally of the platform and drum so that its opposite end is raised and is located in a position where it will deposit heavy materials on a primary conveyor located beneath the upper end of the drum. Thus, when the drum and platform are raised and lowered the conveyor section will move correspondingly and will always maintain a fixed spaced relation with the lower end of the drum. Thus, heavy materials may be dropped from the lower end of the drum onto the conveyor section without causing any damage, and the conveyor section will transport them to the primary conveyor which will in turn carry them away for further processing or disposal.

BRIEF DESCRIPTION OF THE DRAWINGS

The above and other objectives of this invention will become apparent from the following description taken in connection with the accompanying drawings, wherein.

DESCRIPTION OF THE PREFERRED EMBODIMENT

Figure 1:
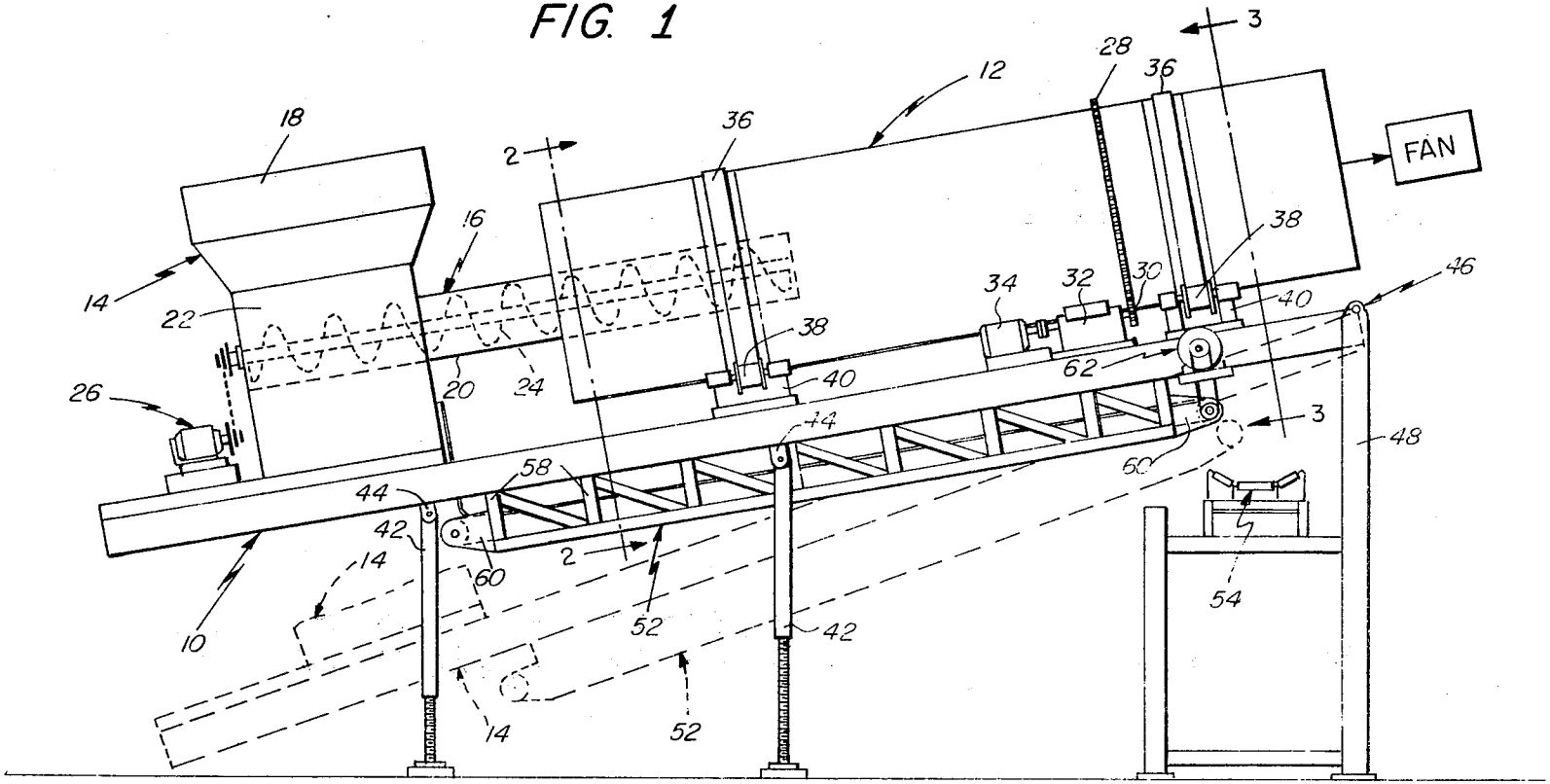
FIG. 1 is a front elevational view of a rotary drum air classifier and conveyor in accordance with this invention.

Referring more particularly to the drawings wherein like characters of reference designate like parts throughout the several views, the apparatus shown in FIG. 1 includes a platform or base 10 upon which is supported a rotary drum 12 and a feed hopper 14.

The feed hopper 14 receives shredded raw material from an adjacent conveyor (not shown) and directs it to a screw feed 16 which deposits it within the rotatable air drum classifier 12. The drum classifier separates the raw materials into light and heavy materials in the known fashion of devices of this character. The drum is angled at a selected inclination, such as 10° for example, and air is caused to flow through it at high velocity by means of a fan, for instance, as shown in FIG. 1. As raw materials drop from the end of the screw feed onto the bottom of the drum wall, the heavy materials will be rotated upwardly with the drum to a height from which they eventually will fall to a lower point within the drum. This action is repeated until eventually the heavy materials fall out of the lower end of the drum onto a conveyor which will carry them away for further processing or disposal.

The light materials will be entrained within the high velocity air stream and will be carried out the upper end of the drum 12 for further processing or use.

The feed hopper 14 is provided with a bucket portion 18 at its upper end into which the raw materials are deposited from the adjacent conveyor. These raw materials have previously been shredded so that they comprise a mixture of raw material elements not exceeding about 12 inches in size, for example.

A feed duct or conduit 20 extends from the base 22 of the feed hopper 14 into the adjacent end of the drum 12.

Within the duct 16 is a screw 24, one end of which is mounted in the hopper base 22 to receive the raw materials from bucket 18. Hopper 14 is mounted upon the base or platform 10 which also supports the drum 12.

Screw 24 is driven by a motor and chain drive 26 so that the raw materials will be moved along duct 20 into the drum interior. The duct is preferably open at its end within the drum, and is apertured at the bottom adjacent the end wall so that the heavier raw materials will fall through the aperture onto the drum wall preferably at a point within the first third of the length of the drum, while the lighter materials will be carried by the high velocity air stream through and out the upper end of the drum.

At a point intermediate its length the drum is provided with a fixed circumferential sprocket wheel 28 which meshes with a chain link drive belt carried by a pair of smaller sprocket wheels 30 beneath the drum. One sprocket wheel 30 is rotatably mounted on one end of a reduction gear box 32 which is interconnected with drive motor 34 on platform 10 whereby rotation of the drum is accomplished.

The platform 10 and consequently the drum 12 thereon is angled to a selected inclination, such as 10° for example. To prevent longitudinal displacement of the drum there are provided two fixed restraining rings or collars 36 extending around the circumference of the drum and spaced from respective ends thereof. Each ring 36 engages a respective pair of rollers 38 mounted by suitable bearings in a support 40 carried by the platform 10. Flanges on the sides of the rollers 38 prevent longitudinal movement of the drum as it is rotated.

As shown in FIG. 1, the angle of inclination of the drum 12 may be altered to vary the velocity of the air flowing through the drum and to thereby vary the ratio of lights- to-heavies being separated within the drum. Such changing of the angle of inclination of the drum may be accomplished by means of threaded or telescopic jackposts 42, for example, which are suitably interchangeably mounted beneath the drum 16 and attached to it as by clevis devices 44.

It is important in some installations to retain the upper end of the drum constantly in adjusted position with respect to other apparatus. Therefore, the upper end of the drum is pivoted as by a suitable bearing and shaft arrangement 46 carried preferably by the adjacent end of the platform 10 and pivotally mounted at the upper ends of fixed supports or standards 48. Thus, the platform 10 can be raised and lowered by manipulation of the posts 42, causing the drum to be angled about the axis of the pivotal connection 46. Other means may, of course, be employed for supporting the platform 10 for pivotal vertical movement. It is to be understood, however, that raising and lowering of the lower end of the platform will effect corresponding movement of the drum about the axis of pivotal connection 46.

Air at high velocity is forced through the drum 12 by means of fans or blowers, not shown, located in any convenient position.

Figure 2:
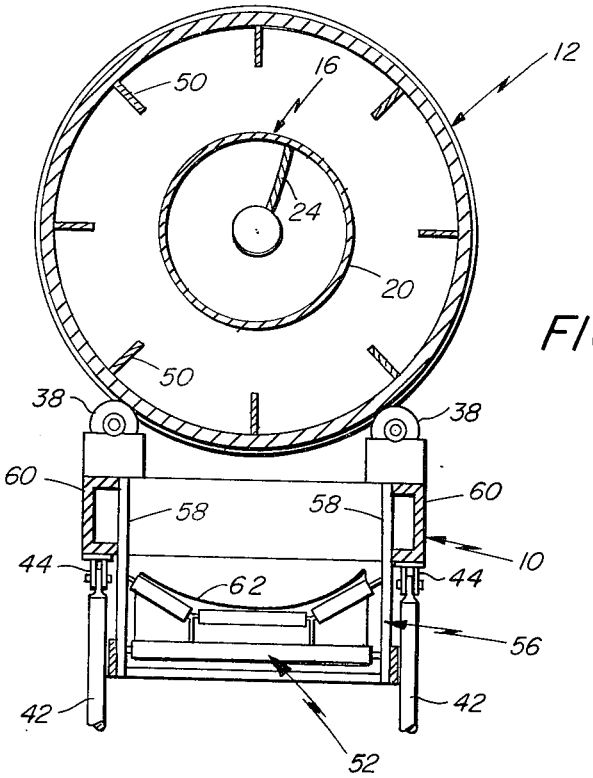
FIG. 2 is an enlarged vertical sectional view taken substantially on line 2—2 of FIG. 1 looking in the direction of the arrows.
Figure 3:
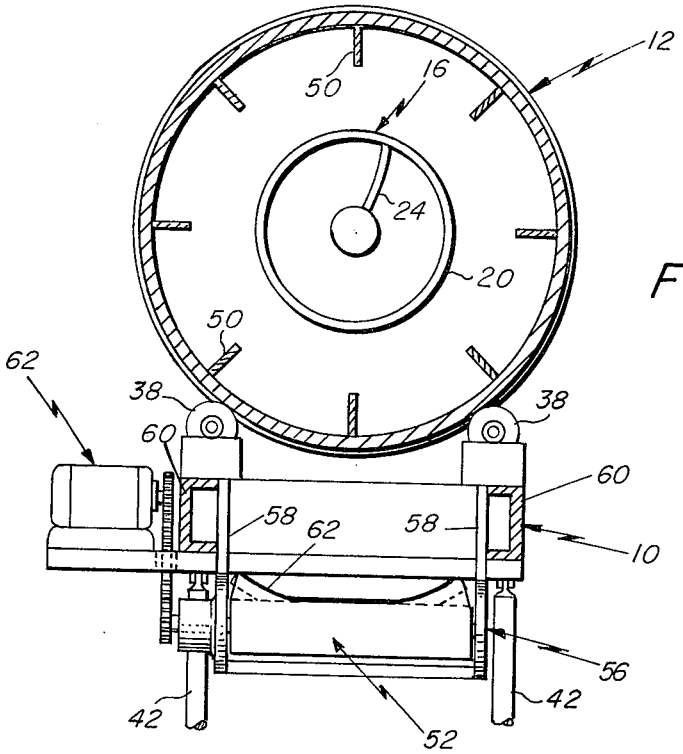
FIG. 3 is an enlarged vertical sectional view taken substantially on line 3—3 of FIG. 1 looking in the direction of the arrows.

In the construction and operation of an air drum classifier of this sort,. there are provided a series of spaced longitudinally extending ribs or vanes 50 (FIGS. 2 and 3) on the inner wall of the drum 12 which function as lifters to raise the heavy materials, as the drum rotates, to a height from which they may be dropped again to the bottom of the drum. It will be understood that since the drum is inclined the heavy materials will be dropped nearer the lower end of the drum. Therefore, continued rotation of the drum and lifting and dropping of the heavy materials will move the materials toward the lower end of the drum until they eventually fall out of the drum onto a conveyor. A considerable amount of the light materials emanating from the end portion of the feed duct 20 will be entrained in the high velocity air stream as the raw materials drop from the duct onto the drum wall and will be drawn out of the upper end of the drum. However, some small amounts of light materials will be mixed with the heavy materials falling onto the drum wall. These light materials will, of course, also be raised by the lifters and will eventually be removed by the air stream during the repetitive drops as the drum is rotated. Consequently substantially all of the light materials will eventually be separated and removed. In a conventional installaton, the heavy materials falling out of the lower end of the drum will be carried away by a conveyor which is located in a fixed position beneath the end of the drum. However, in the present invention the drum is raised and lowered to control the velocity of air passing through the drum and consequently vary the ratio of light-to-heavy materials being separated within the drum.

A primary conveyor, preferably a trough-shaped belt conveyor, is usually disposed beneath the lower end of the drum in order to receive and carry away the heavy materials dropping from the drum. It will be apparent that if the drum is inclined to a relatively extreme angle of inclination from the horizontal, the distance from the primary conveyor to the drum may be relatively short. Therefore, the heavy materials will fall a short distance to the conveyor with relatively low impact thereon. However, as the end of the drum is raised toward the horizontal, the distance between it and the conveyor increases. Accordingly, when the drum is in one of its higher positions, the heavy materials are required to fall a considerable distance, sometimes a distance of several feet when large drums are used. It will be apparent that in such cases the heavy materials will impact very heavily upon the conveyor, possibly causing damage to it. In some cases also the materials might actually miss engagement with the conveyor altogether.

Therefore, to overcome this objection in accordance with this invention, the platform carries a secondary or associate conveyor section 52 which is located in a fixed position beneath the platform 10 and is always retained in relatively close-spaced relation to the drum 12 at its lower end so that heavy items will fall only a relatively short distance to the conveyor section. The conveyor section extends longitudinally of the platform and drum so that its opposite end is raised and is located in a position where it will deposite heavy materials on a primary conveyor 54 fixedly located beneath the upper end of the drum. Thus, when the drum and platform are raised and lowered the attached conveyor section 52 will move correspondingly and will always maintain a fixed spaced relation with the lower end of the drum. Thus, heavy materials may be dropped from the lower end of the drum onto the conveyor section 52 without causing any damage, and the conveyor section 52 will transport them to the primary conveyor 54 which will in turn carry them away for further processing or disposal.

The attached associate conveyor section 52 is mounted in a frame 56 which includes struts 58 which are welded or otherwise fixed to the platform 10. The platform 10 is preferably comprised of a pair of longitudinally extending spaced members such as channel irons 60 to which the struts 58 are fixed in depending fashion. The end struts 58 carry rigid brackets 60 in which the conveyor rollers are rotatably mounted, with belt 62 being extended between the rollers in the usual manner. A motor and chain drive 62 is suitably mounted on the platform for effecting operation of the conveyor section 52.

Thus, the conveyor section 52 is fixed to the platform 10 and thus retains its spacial relation to the drum at all times whatever the angle of inclination may be. Since one end of the conveyor section is suitably extended beneath the lower end of the drum, it will be apparent that it will effectively intercept all heavy materials which fall out of the lower end of the drum and will carry them to its other end where they will then be deposited upon a fixedly located primary conveyor 54. Thus, no damage will occur to the conveyor means by the dropping of heavy items a considerable distance from the end of the drum.

Accordingly, from the foregoing it will be apparent that all of the advantages and objectives of this invention have been achieved by the apparatus shown and described which provides means for retaining conveyor means in fixed spatial relation to an adjustable rotary drum at any selected angle of inclination.

It is to be understood, however, that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. A rotary drum classifier means for separating materials comprising a base, a cylindrical open-ended drum mounted for rotation on said base and extending longitudinally thereof, the base and drum being vertically movable as a unit about an axis located at one end thereof, and a conveyor carried by the base and movable therewith, the conveyor having one end projecting beyond the end of the drum opposite said axis to collect material dropping out of the adjacent end of the drum.

2. The combination as set forth in claim 1 wherein said conveyor extends longitudinally of and substantially parallel with said base and drum.

3. The combination as set forth in claim 1 wherein said base is inclined to position the drum at a selected angle of inclination, fixed support means for supporting the higher end of the base and drum for pivotal movement vertically about said axis, and adjustable support means for adjustably supporting the lower end of the base and drum, and said conveyor is fixed to the under side of said base.

4. A rotary drum classifier means for separating materials comprising an elongated base, a hopper mounted on the base adjacent one end thereof for receiving materials to be classified, an open-ended drum rotatably mounted on the base for rotary movement about its longitudinal axis, conveying means for transporting materials from said hopper into said drum, pivotal means for supporting the base at the end thereof remote from the hopper, means for raising and lowering the opposite end of the base about the axis of said pivotal means for thereby adjusting the angle of inclination of the drum, a first conveyor fixed to the under side of the base and having one end portion disposed to receive materials dropping from the end of the drum nearest the hopper, and a second conveyor disposed adjacent the opposite end of the first conveyor to receive said materials therefrom.

5. Apparatus as set forth in claim 4 wherein said first conveyor is fixed to the base for movement therewith, the end of the first conveyor nearest the hopper being retained in fixed spacial relation to the adjacent end of the drum during the full extent of its movement about said axis, and the opposite end of the first conveyor being retained relatively close to said second conveyor during movement of the drum about said axis.

6. Apparatus as set forth in claim 5 wherein said first conveyor extends longitudinally of and substantially parallel with said base and drum.

7. Apparatus as set forth in claim 5 wherein there is further provided fixed support means for supporting the higher end of the base and drum for pivotal movement vertically about said axis, and adjustable support means for adjustably supporting the lower end of the base and drum, and said conveyor is fixed to the under side of said base.

* * * * *